US006821148B2

(12) United States Patent
Puettner et al.

(10) Patent No.: US 6,821,148 B2
(45) Date of Patent: Nov. 23, 2004

(54) PLUG PART HAVING A MULTIPOLE SEAL MANUFACTURED FROM GEL OR SILICON

(75) Inventors: Achim Puettner, Hofen (DE); Markus Lux, Waiblingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/963,198

(22) Filed: Sep. 25, 2001

(65) Prior Publication Data

US 2002/0072273 A1 Jun. 13, 2002

(30) Foreign Application Priority Data

Sep. 28, 2000 (DE) ..... 200 16 744 U

(51) Int. Cl.[7] ..... H01R 13/40

(52) U.S. Cl. ..... 439/587; 439/204; 439/281; 439/41

(58) Field of Search ..... 439/587–589, 439/204, 41, 281–282, 599

(56) References Cited

U.S. PATENT DOCUMENTS 5,342,223 A * 8/1994 Geib ..... 439/752
5,529,508 A * 6/1996 Chiotis et al. ..... 439/204
5,762,513 A * 6/1998 Stine ..... 439/358
5,766,038 A * 6/1998 Sugie ..... 439/587
5,766,039 A * 6/1998 Abe ..... 439/587
6,190,203 B1 * 2/2001 Murakami et al. ..... 439/587

* cited by examiner

*Primary Examiner*—Truc T. T. Nguyen
(74) *Attorney, Agent, or Firm*—Kenyon & Kenyon

(57) ABSTRACT

A plug part, in particular a cable harness plug, for producing an electrical plug connection to a further plug part, includes a housing, a contact carrier situated in the housing, as well as a gel or silicon multipole seal situated on the side facing away from the plugging direction. To enable the contacts situated in the contact carrier to be automatically inserted, it is provided that a flat surface is formed on the side facing away from the plugging direction, i.e., on the outgoing side of the cable, so that no interfering contour exists for the automatic insertion gripper. For this purpose, it is provided that a flat holding plate having insertion openings and being able to latch to the contact carrier is provided on the multipole seal, on the side of the plug part facing away from the plugging direction, locking arms hinged to and extending away from the holding plate being formed in the plugging direction of the plug part.

4 Claims, 1 Drawing Sheet

PLUG PART HAVING A MULTIPOLE SEAL MANUFACTURED FROM GEL OR SILICON

FIELD OF THE INVENTION

The present invention relates to a plug part, in particular a cable harness plug, for producing an electrical plug connection to a further plug part, essentially including a housing;

a contact carrier situated in the housing; and a multipole seal manufactured from gel or silicon and situated on the side facing away from the plugging direction.

BACKGROUND INFORMATION

Plug parts have a compact design. They typically have a contact carrier upper part, which, on the side facing away from the plugging direction, i.e., on the outgoing side of the cable, accommodates contacts that are situated in the contact carrier and that are either inserted by automatic insertion (fitting) equipment or are accordingly electrically connected to a cable, for example. The lower part of the contact carrier is used for producing the electrical plug connection to a further plug part.

The upper part of the contact carrier also has a gel or silicon seal, which is situated within a frame.

A disadvantage of the preceding type of plug parts is that such frames that accommodate the gel or silicon seal are not suitable for automatic insertion equipment since this frame is to be viewed as an interfering contour. This means that the actual insertion plane is recessed in the upper part of the contact carrier, and that additional sidewalls, latches, and locking hooks may exist at the upper part of the contact carrier. This complicates the automatic insertion or renders it impossible.

SUMMARY OF THE INVENTION

Therefore, an object of the present invention is to provide a plug part in such a manner that the disadvantages of the related art are avoided.

The object is achieved in that a flat holding plate having insertion openings and being able to latch to the contact carrier is provided on the multipole seal, on the side of the plug part facing away from the plugging direction, locking arms hinged to and extending away from the holding plate being formed in the plugging direction of the plug part.

A fundamental advantage of the present invention is that a completely flat surface is created that enables the plug part to be automatically inserted in a simple manner.

Preferably, the holding plate is designed as a plastic plate resting directly on the gel or silicon seal. It has openings via which the plug pins are accordingly inserted.

The locking arms are advantageously hinged directly at the edge of the holding plate and have detent hooks at their free ends that engage with cutouts provided in the contact carrier. As a result, it is possible to simply place the holding plate on the contact carrier prior to insertion.

In comparison with the detent hooks, the cutouts are dimensioned to be larger in the plugging direction in order to enable play of the holding plate in the plugging direction, so that, if possible, the insertion gripper does not destroy the plug part during the automatic insertion.

After assembly, the holding plate itself can remain on the plug part since it in no way affects the actual functioning of the plug part.

DETAILED DESCRIPTION

Figure 1:
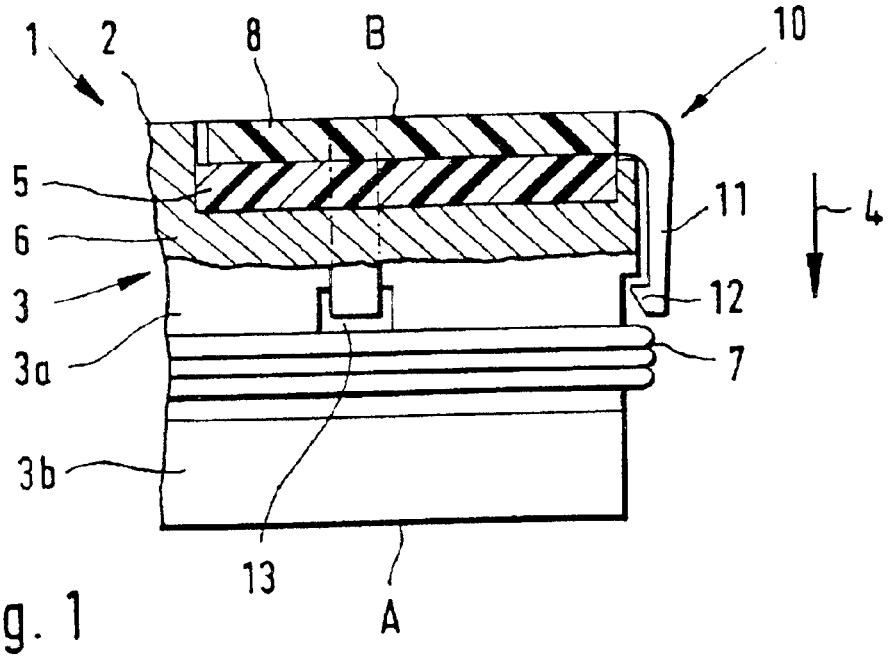
FIG. 1 shows a section of the plug part of the present invention, having a gel or silicon seal and a holding plate according to the present invention.
Figure 2:
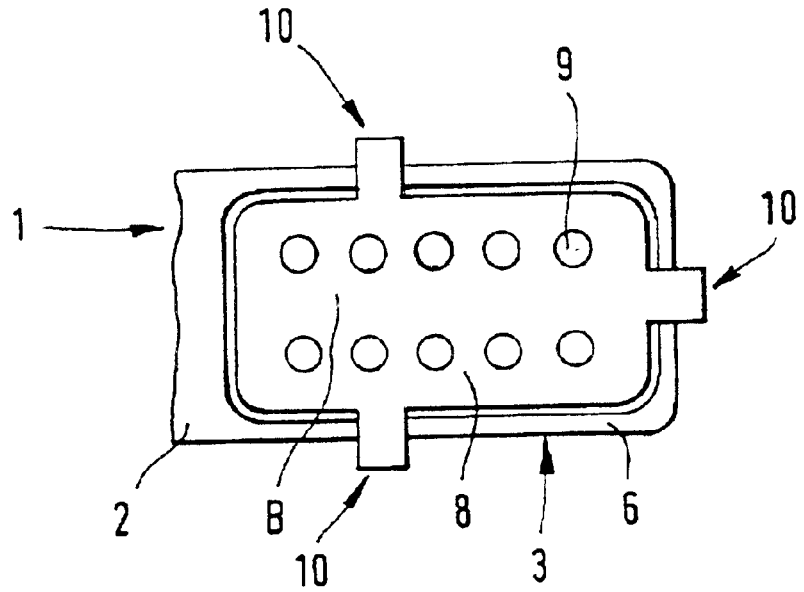
FIG. 2 shows a top view of the plug part according to FIG. 1.

Plug part 1 according to the present invention is shown in FIGS. 1 and 2. The plug part includes a housing 2, a contact carrier 3 situated in housing 2; a gel or silicon multipole seal 5 situated on side A facing in the plugging direction (arrow 4). Multipole seal 5 is surrounded by a frame 6, which is part of contact carrier 3.

In the exemplary embodiment represented in FIGS. 1 and 2, contact carrier 3 is subdivided into a contact carrier upper part 3*a* and a contact carrier lower part 3*b*, the latter being used for producing the electrical plug connection to a further plug part not shown in the figures. A peripheral radial seal 7 is located between contact carrier upper part 3*a* and contact carrier lower part 3*b*.

In accordance with the present invention, it is provided that a holding plate 8 is placed directly on contact carrier upper part 3*a*, so that a flat insertion surface B is created for the automatic insertion. In this context, holding plate 8 has insertion openings 9 (FIG. 2) via which contacts (not shown in the figures), which are situated in contact carrier 3, can be inserted.

Holding plate 8 further has detent elements 10 via which holding plate 8 can be attached to contact carrier 3. Detent elements 10 are designed in the form of locking arms 11, which, in an assembled state at contact carrier 3, preferably extend perpendicularly away from the contact carrier, namely in the plugging direction (arrow 4). Provided at the free end of locking arms 11 are detent hooks 12, which engage with cutouts 13, which are provided in contact carrier 3. Thus, it is ensured that holding plate 8 can be attached to contact carrier 3 in a simple manner.

To enable a minimally flexible bearing arrangement of holding plate 8, cutouts 13 are dimensioned to be larger, at least in the plugging direction (arrow 4).

Therefore, it is possible in a simple manner to create a flat insertion surface B, which produces an optimal processing surface for the automatic insertion.

What is claimed is:

1. A plug part for producing an electrical plug connection to a further plug part, comprising:

a contact carrier;

a multipole seal composed of one of gel and silicon, the multipole seal being situated on a side of the plug part facing away from a plugging direction of the plug part;

a flat holding plate having insertion openings and being adapted to latch to the contact carrier, the holding plate being situated on the multipole seal, on the side of the plug part facing away from the plugging direction of the plug part; and locking arms hinged to and extending away from the holding plate, each proximal end of the locking arms being hinged to a surface of the holding plate facing away from the plugging direction of the plug part, and each free end of the locking arms being situated in the plugging direction of the plug part.

2. The plug part according to claim 1, wherein the plug part is a cable harness plug.

3. The plug part according to claim 1, wherein the holding plate exhibits play in the plugging direction.

4. The plug part according to claim 3, further comprising detent hooks situated at the free end of the locking arms, wherein the contact carrier has cutouts, the detent hooks engage with the cutouts and the cutouts are larger in the plugging direction than the detent hooks, and wherein a surface of the proximal end of the locking arms is integral with the surface of the holding plate facing away from the plugging direction.

* * * * *